US007165668B2

(12) United States Patent
Dombek

(10) Patent No.: US 7,165,668 B2
(45) Date of Patent: Jan. 23, 2007

(54) APPARATUS AND METHOD FOR THE DELIVERY OF ROD-SHAPED ARTICLES

(75) Inventor: Manfred Dombek, Dassendorf (DE)

(73) Assignee: Hauni Maschinenbau AG, Hamburg (DE)

( * ) Notice: Subject to any disclaimer, the term of this patent is extended or adjusted under 35 U.S.C. 154(b) by 59 days.

(21) Appl. No.: 10/965,765

(22) Filed: Oct. 18, 2004

(65) Prior Publication Data

US 2005/0082141 A1 Apr. 21, 2005

(30) Foreign Application Priority Data

Oct. 21, 2003 (EP) ..... 03090356

(51) Int. Cl.
*B65G 47/28* (2006.01)

(52) U.S. Cl. ..... 198/459.8; 198/471.1; 198/474.1; 198/478.1; 198/428

(58) Field of Classification Search ..... 198/471.1, 198/474.1, 478.1, 428, 432, 459.8
See application file for complete search history.

(56) References Cited

U.S. PATENT DOCUMENTS

| | | | | |
|---|---|---|---|---|
| 3,825,105 | A | 7/1974 | Cristiani | |
| 4,406,197 | A | 9/1983 | Bardenhagen et al. | |
| 4,827,948 | A * | 5/1989 | Schumacher | 131/282 |
| 4,938,337 | A * | 7/1990 | Jowitt et al. | 198/377.03 |
| 5,154,278 | A * | 10/1992 | Deutsch | 198/475.1 |
| 5,154,687 | A * | 10/1992 | Jeslis | 493/12 |
| 5,255,777 | A * | 10/1993 | Pawelko | 198/471.1 |
| 5,267,577 | A * | 12/1993 | Rizzoli et al. | 131/94 |
| 5,322,157 | A * | 6/1994 | Dahlgrun | 198/471.1 |
| 5,480,021 | A * | 1/1996 | Belvederi et al. | 198/471.1 |
| 5,988,354 | A * | 11/1999 | Spatafora et al. | 198/471.1 |
| 6,325,201 | B1 * | 12/2001 | Bailey et al. | 198/471.1 |
| 6,648,122 | B1 * | 11/2003 | Hirsch et al. | 198/377.08 |
| 6,672,446 | B1 * | 1/2004 | Boldrini et al. | 198/471.1 |
| 7,070,039 | B1 * | 7/2006 | Dombek | 198/432 |
| 2002/0043269 | A1 | 4/2002 | Boldrini et al. | |

FOREIGN PATENT DOCUMENTS

| | | |
|---|---|---|
| DE | 1105324 | 4/1961 |
| DE | 3128059 | 4/1982 |
| EP | 1174047 | 1/2002 |
| WO | 99/56568 | 11/1999 |

* cited by examiner

*Primary Examiner*—Joe Dillon, Jr.
(74) *Attorney, Agent, or Firm*—Greenblum & Bernsteim, P.L.C.

(57) ABSTRACT

An apparatus for transferring rod-like articles from a longitudinal conveyor that longitudinal-axially conveys the articles onto a transverse conveyor that transverse-axially conveys the articles. Moreover, the apparatus includes a conveyor that receives the articles from the longitudinal conveyor and delivers the articles to the transverse conveyor, the conveyor comprising at least a first conveying element and a separate second conveying element which are configured to be in functional connection with one another. Additionally, the first conveying element being structured and arranged to rotate the articles by a predetermined angle. Furthermore, the second conveying element being structured and arranged to reduce the transport speed of the articles. The instant abstract is neither intended to define the invention disclosed in this specification nor intended to limit the scope of the invention in any way.

17 Claims, 6 Drawing Sheets

APPARATUS AND METHOD FOR THE DELIVERY OF ROD-SHAPED ARTICLES

CROSS-REFERENCE TO RELATED APPLICATIONS

The present application claims priority under 35 U.S.C. §119 of European Patent Application No. 03 09 0356.1, filed on Oct. 21, 2003, the disclosure of which is expressly incorporated by reference herein in its entirety.

BACKGROUND OF THE INVENTION

1. Field of the Invention

The present invention relates to an apparatus for the transfer of rod-shaped or rod-like articles, in particular cigarettes, from a longitudinal conveyor for longitudinal-axial conveying of the articles onto a transverse conveyor for transverse-axial conveying of the articles. The apparatus includes a conveyor to receive the articles from the longitudinal conveyor and to deliver the articles to the transverse conveyor. Moreover, the conveyor is designed to rotate the articles by a predetermined angle and to reduce the transport speed of the articles. Furthermore, the present invention relates to a method for the transfer of rod-like articles, in particular cigarettes, from a longitudinal conveyor for longitudinal-axial conveying of the articles onto a transverse conveyor for transverse-axial conveying of the articles.

2. Discussion of Background Information

Apparatuses and methods of the type mentioned are used particularly in the tobacco-processing industry. Furthermore, in a continuous cigarette rod-making machine, strands of tobacco are produced which are usually divided into tobacco sticks having single or preferably double cigarette length. The tobacco sticks are conveyed in their longitudinal direction and have to be transferred for further transport or for further processing, for example for applying a filter, on a filter-application machine. For this purpose, the tobacco sticks usually have to be transferred from their longitudinal-axial transport direction into a transverse-axial transport direction.

Various apparatuses and methods for the transfer of rod-like articles from a longitudinal conveyor onto a transverse conveyor are known. For example, the known apparatuses have a conveyor, which is designed to receive the articles from the longitudinal conveyor. The conveyor is designed such that the main function of the apparatus, namely the braking of the articles, takes place during a rotation of the conveying element by 90°. Additionally, the conveyor is designed to deliver the articles to the downstream transverse conveyor. In a method of using the apparatus, the articles are taken from the longitudinal conveyor at strand speed, wherein the axial strand speed is completely reduced before the articles are delivered and radially accelerated to the downstream transverse conveyor. This braking or acceleration process is carried out, as is known, along the transport path of the articles on the conveyor of 90°, which leads to a considerable stress due to high (positive and negative) accelerations of the articles. However, the forces acting in axial direction of the articles in particular are undesirable since they lead to damage, for example so-called head loss in tobacco sticks.

An intermediate conveyor, which is designed as a flat-bed conveyor, is known from WO 99/56568. Transport elements, which co-operate with a closed conveying system, are arranged on the flat-bed conveyor, wherein the closed conveying system has a track having different radii. Receiver heads for the cigarettes as part of the transport elements of the intermediate conveyor follow the closed conveying system, namely the conveying track. Additionally, a speed change is thus achieved so that the cigarettes are received at a first speed, rotated during transport and delivered at a second speed which is lower than the first speed. This intermediate conveyor is, however, very complex in construction and the articles to be transported, that is in particular the cigarettes, are exposed in their axial direction during braking or acceleration to forces, since the rotation of the cigarettes and the braking of the cigarettes take place in a superimposed movement, so that the cigarettes are stressed in their axial direction. Furthermore, this intermediate conveyor facilitates only a limited transfer capacity which is no match for the requirements or the possible capacities of modern continuous cigarette rod-making machine.

SUMMARY OF THE INVENTION

It is therefore an aspect of the present invention to provide an efficient apparatus which is suitable to ensure gentle transfer of rod-like articles from a longitudinal conveyor onto a transverse conveyor. Furthermore, an additional aspect of the present invention is to propose a method for the gentle transfer of articles from a longitudinal conveyor onto a transverse conveyor.

One aspect is achieved by an apparatus of the type mentioned in the introduction in that the conveyor has at least two separate conveying elements which co-operate with one another. One conveying element is designed to rotate the articles by a predetermined angle and the other conveying element is designed to reduce the transport speed of the articles. Thereby, gentle transfer of the articles, namely in particular the cigarettes, from the longitudinal conveyor to the transverse conveyor is thus achieved in a particularly effective and simple manner. By dividing the main functions of the apparatus, rotation of the articles and reduction of the transport speed of the articles over two independent conveying elements, the transport path of the articles as a whole is extended. In other words, the functions which stress the articles are divided over an extended transport path, as a result a longer process duration for each process cycle is achieved, and specifically without reducing the "output" or the capacity of the apparatus. This leads to protection of the articles.

The two conveying elements are advantageously arranged one behind the other in transport direction of the articles. In particular, the first conveying element, in transport direction of the articles, is designed to rotate the articles and the second conveying element is designed to reduce the conveying speed. This design according to the present invention ensures, in addition to extension of the transport path, that the forces acting during braking or acceleration of the articles on the latter act exclusively in a direction vertically/transversely to the axial direction. By rotating the articles before braking, stress of the articles in axial direction may be effectively reduced. This applies particularly to tobacco sticks, in which the so-called head loss, that is, the falling-out of tobacco product from the tobacco stick caused by a delay is avoided.

In a preferred embodiment of the present invention, several, preferably four, receiving elements are combined to remove and deliver the articles to a trough segment. The parallel and gentle transfer of several, preferably four, articles, in particular four double tobacco sticks, is thus ensured.

The first conveying element can comprise several, preferably eight, trough segments, which are designed to be rotatable in each case about a rotary axis. This has the advantage that several trough segments are always occupied, so that one single transfer process may take place for the duration of several process cycles. Due to the possibility of rotation, the articles may be brought into a required position, in which the stress on the articles is reduced, before braking.

A further advantageous embodiment of the present invention envisages that the second conveying element comprises several, preferably six, trough segments, which are designed to be movable in each case to change the radius. A reduction of the transport speed of the articles in the region of the second conveying element is thus achieved in constructively simple manner.

Furthermore, an aspect of the present invention is achieved by a method of the type mentioned in the introduction, which includes receiving several rod-like articles from the longitudinal conveyor at a strand speed by a first conveying element and rotating the articles by an angle of 90° about an axis likewise by the first conveying element. Moreover, the method includes transferring the articles from the first conveying element to a second conveying element, braking the articles to a speed which is less than the strand speed by the second conveying element, and delivering the articles to the transverse conveyor. Using this sequence it is possible to protect the articles during transfer from the longitudinal conveyor to the transverse conveyor, since the main functions, rotation of the articles and braking of the articles, are divided over two sequential working steps. A reduction of the force effect in axial direction on the articles is effectively ensured by the step sequence "first rotate, then brake." Furthermore, the step sequence ensures extension of the transport path. In other words, the rotation and the braking are divided over an extended transport path/conveying path, as a result of which the articles are less stressed.

Braking of the articles preferably takes place due to changes in the radius of the second conveying element. This ensures that, independently of the strand speed and of the division of the articles over the strand conveyor, delivery of the articles with division which is necessary for subsequent processing and a speed matching the division is ensured.

One aspect of the present invention includes an apparatus for transferring rod-like articles from a longitudinal conveyor that longitudinal-axially conveys the articles onto a transverse conveyor that transverse-axially conveys the articles. Moreover the apparatus includes a conveyor that receives the articles from the longitudinal conveyor and delivers the articles to the transverse conveyor, the conveyor comprising at least a first conveying element and a separate second conveying element which are configured to be in functional connection with one another. Additionally, the first conveying element being structured and arranged to rotate the articles by a predetermined angle. Furthermore, the second conveying element being structured and arranged to reduce the transport speed of the articles.

A further aspect of the present invention, the apparatus can include the first and second conveying elements can be arranged one after another, i.e., sequentially, in a transport direction of the articles. Moreover, the second conveying element can be positioned downstream of the first conveying element. Additionally the first and second conveying elements can each be structured and arranged as rotational bodies that include one of a drum and disc configured to be driven to rotate about a rotational axis. Furthermore, each conveying element can include a plurality of receiving elements that are configured to at least one of remove and deliver the articles. Additionally, the apparatus can include at least one trough segment composed of four receiving elements of the plurality of receiving elements. Moreover, the first conveying element can include eight trough segments configured to pivot about a pivoting axis and are structured and arranged to be rotatable about an axis. Additionally, the second conveying element can include six trough segments which are structured and arranged to be movable to change a radial position. Furthermore, the trough segments can be arranged on pivoting levers such that the trough segments can be configured to be moved on a plurality of track curves each having different radius. Additionally, a transport path of the articles within the conveyor can be at least 360°. Moreover, a transport path to rotate the articles and the transport path to reduce the conveying speed of the articles can each be at least 180°. Furthermore, rotational axes of the first and second conveying elements can be parallel to one another. Furthermore, rotational axes of the first and second conveying elements can be transverse to one another. Additionally, the rod-like articles can be cigarettes.

Yet another aspect of the present invention includes a method for transferring rod-like articles from a longitudinal conveyor for longitudinal-axial conveying of the articles onto a transverse conveyor for transverse-axial conveying of the articles. The method includes receiving a plurality of rod-like articles from the longitudinal conveyor at a strand speed by a first conveying element and rotating the articles by an angle of 90° about an axis by the first conveying element. Moreover, the method includes transferring the articles from the first conveying element to a second conveying element and braking the articles to a speed, which is less than the strand speed, by the second conveying element. Additionally, the method includes delivering the articles to the transverse conveyor.

A further aspect of the method of the present invention, the rotation of the articles can take place during transport on a transport path of about 180° about a rotational axis of the first conveying element. Moreover, braking of the articles can take place during transport on a transport path of about 180° about a rotational axis of the conveying element. Additionally, the braking of the articles can take place due to changes in a radial position of the second conveying element. Moreover, the articles can be guided at least in a region of a receiving position and a taking-over position. Additionally, the articles can be pivoted and guided about a pivoting axis. Furthermore, movements about at least two of the rotational axis of the first conveying element, the pivoting axis, and the axis can be superimposed. Additionally, the braking of the articles can take place due to a superimposed movement of the articles to the conveying element. Moreover, the rod-like articles can be cigarettes. Furthermore, a conveyor that conveys rod-like articles can use the method noted above.

Yet another aspect of the present invention includes an apparatus for transferring rod-like articles from a longitudinal-axially conveyed direction to a transverse-axially conveyed direction. Additionally, the apparatus includes a first conveyor structured and arranged to rotate the articles by a predetermined angle and a second conveyor structured and arranged to reduce the transport speed of the articles. Moreover, the first and second conveyors are respectively arranged one after another in transport direction of the articles.

A further aspect of the present invention the first and second conveyors can each be structured and arranged as rotational bodies that comprise one of a drum and disc which can be configured to be driven to rotate about a respective rotational axis. Moreover, each conveyor can include a plurality of receiving elements that are configured to at least one of remove and deliver the articles. Additionally, the apparatus can include at least one trough segment having four receiving elements of the plurality of receiving elements. Moreover, the rod-like articles can be cigarettes.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The apparatuses described and the method of the present invention serve to transfer cigarettes or tobacco sticks from a continuous cigarette rod-making machine to a downstream machine, in particular a filter-attaching machine.

Figure 1:
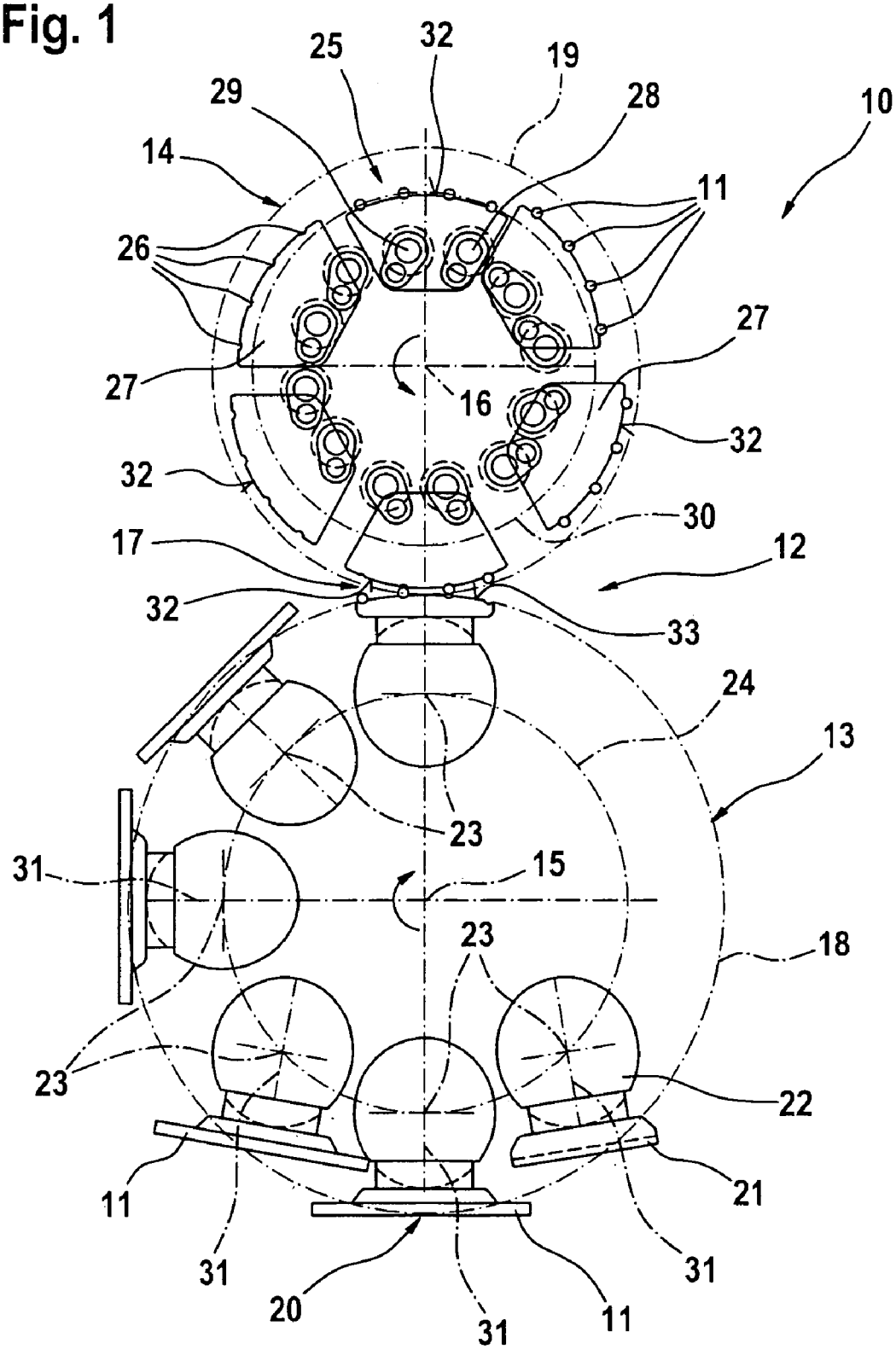
FIG. 1 shows a front view of the apparatus having a receiving drum and a delivery drum.
Figure 2:
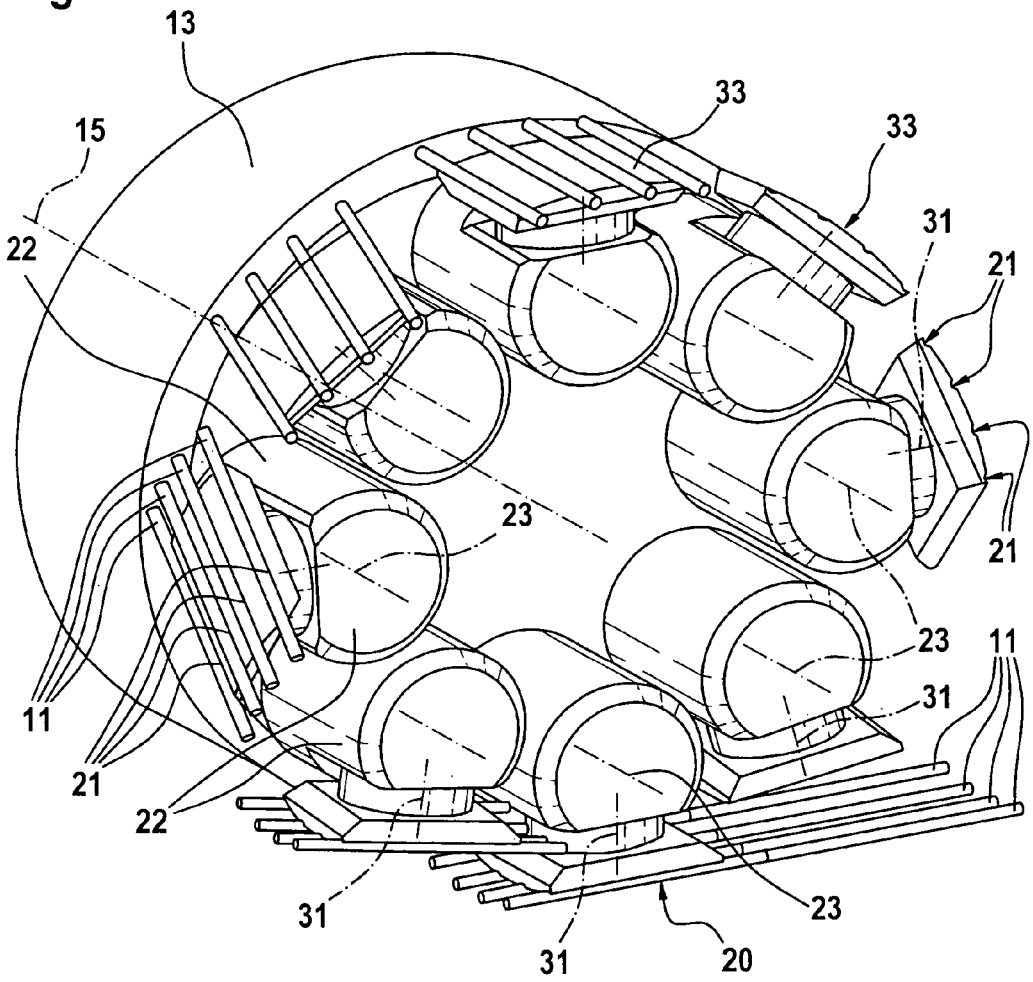
FIG. 2 shows a perspective view of the receiving drum according to FIG. 1.

A first embodiment of an apparatus 10 for the transfer of rod-like articles 11, namely for example tobacco sticks of double cigarette length from a longitudinal conveyor (not shown) onto a transverse conveyor (likewise not shown) is shown in FIG. 1. However, other articles can likewise be transported. The apparatus 10 comprises a conveyor 12, which is formed in FIG. 1 from two separate conveying elements 13 and 14. The conveying elements 13, 14 are arranged one behind the other in transport direction of the tobacco sticks. The conveyor 12 serves to receive the tobacco sticks from the longitudinal conveyor in longitudinal-axial alignment of the tobacco sticks and to deliver the tobacco sticks in transverse-axial alignment of the tobacco sticks onto the transverse conveyor.

The conveying elements 13, 14 are designed as rotary bodies, preferably as drums and can be driven to be rotating about rotational axes 15 or 16. Each conveying element 13, 14 usually has a separate drive. The drives can preferably be controlled and/or regulated via a common control and can be matched to one another particularly with regard to the rotational speeds. The rotary bodies may also be designed as discs or in a different conventional form. The rotational axes 15, 16 run parallel to one another in this embodiment, wherein the rotational axes 15, 16 lie in a vertical plane. The two conveying elements 13, 14, namely a receiving drum and a delivery drum, can be driven in an opposite direction and co-operate with one another in the region of a taking-over position 17, or transfer position, such that the articles 11 can be transferred from an outer track curve 18, or outer curved path, of the conveying element 13 to an outer track curve 19 of the conveying element 14. In the embodiment shown, the radius of the track curve 18 is designed to be greater than the radius of the track curve 19. However, other radii ratios are also possible.

The first conveying element 13, in transport direction of the tobacco sticks, is designed to transport the tobacco sticks at strand speed from a receiving position 20 in the region of the longitudinal conveyor to the taking-over position 17. Moreover, the conveying element 13 is designed to rotate the tobacco sticks by a predetermined angle. In particular, the rotary movement of the articles 11 can be executed in parallel, that is superimposed, for the transport movement about the rotational axis 15. The conveying element 13 has receiving elements 21 to receive the tobacco sticks. The receiving elements 21 serve to remove the tobacco sticks. More specifically, four receiving elements 21 are arranged in parallel next to one another for preferred simultaneous removal of four tobacco sticks conveyed in parallel next to one another and at strand speed, and to transfer the tobacco sticks, preferably for individual transfer of the tobacco sticks to the conveying element 14. In the embodiment shown, four receiving elements 21 are thus combined to form one trough segment 22.

In total, the conveying element 13 has eight such trough segments 22, which are distributed uniformly in equal division over the periphery of the conveying element 13. Hence, for one complete revolution of the conveying element 13 about 360°, eight process cycles are possible. However, a different number of trough segments 22 in altered division can likewise be used. The trough segments 22 are attached to the conveying element 13 and can thus be rotated about the rotational axis 15. Additionally, each trough segment 22 is designed to be pivotable about a pivoting axis 23. In particular, wherein the pivoting movement of the trough segments 22 can be superimposed on the rotational movement of the conveying element 13. The pivoting movement about the pivoting axes 23 serves mainly to follow the trough segments 22 in the region of the receiving position 20 and the taking-over position 17, so that guiding of the articles 11 is guaranteed at the point in time of receiving and taking-over. All rotary axes 23 lie on a track curve 24, the radius of which is less than the radius of the track curve 18. The pivoting axes 23 run parallel to the rotational axis 15 and are arranged concentrically around the latter.

Furthermore, the trough segments 22 or at least the receiving elements 21 are combined to form the trough segment 22 and can be rotated about an axis 31. The axes 31 run vertically to the particular pivoting axes 23 and vertically to the axial direction of the receiving elements 21. The transport path of the conveying element 13 is, for the tobacco sticks, 180° from the receiving position 20 to the taking-over position 17. The trough segments can be rotated on this transport path additionally about the pivoting axis 23 and the axis 31, so that in total at least three movements may proceed one after another and/or simultaneously. Other arrangements having a shorter or longer transport path and further movement possibilities are however also conceivable.

The conveying element 14, downstream of the conveying element 13, is designed to transport the tobacco sticks from the taking-over position 17 to a delivery position 25 and to brake the tobacco sticks to a conveying speed which is less than the strand speed. The conveying element 14 likewise has receiving elements 26 for taking-over the tobacco sticks from the conveying element 13 or from the trough segments 22 to deliver the tobacco sticks to the transverse conveyor. In turn, in each case four receiving elements 26 are combined to form a trough segment 27. Six trough segments 27 are arranged and distributed uniformly over the periphery of the conveying element 14 in the embodiment shown. A lesser or greater number of trough segments 27 and/or a different division of the trough segments 27 can however also be used.

The trough segments 27 have, in the front view (see for example FIG. 1), the shape of a truncated cone. In particular, the broader of the surfaces opposite one another, namely the surface 32 pointing outwards, is designed to be curved. The receiving elements 26 are arranged in the region of this curvature. The trough segments 27 are designed to be movable, in particular to be pivotable. The trough segments 27 are thus arranged on preferably two parallel pivoting levers 28, 29, which are also designated as guides. With the pivoting levers 28, 29, the trough segments 27 can be pivoted during rotation of the conveying element 14 on an annular track, namely a track curve 30, having a radius which is less than the track curve 19. In different embodiments, each individual receiving element 26 may also be arranged on an individual pivoting lever and may be movable radially to change the track curve described by the receiving elements 26.

The previously described curvature of the trough segments 27 or the outer surface 32 in the region of the receiving elements 26 has a radius which is slightly less than the radius of the track curve 19 and corresponds approximately to the radius of the track curve 30. In other words, only one contact point between the conveying element 13 and the conveying element 14 or between the surface 32 of the trough segment 27 and the likewise curved surface 33 of the trough segment 22 is produced in the region of the taking-over position 17. The radius of the curvature of the surface 33 corresponds to the radius of the track curve 18. The trough segments 27 are arranged at a distance from one another in extended state, that is, describing the track curve 19 with the surface 32.

The method is described in detail below using FIGS. 1–7. All processes described below relate to the simultaneous taking-over of four double tobacco sticks lying parallel to one another from a longitudinal conveyor conveying in a longitudinal-axial direction and for individual delivery of the double tobacco sticks in transverse-axial direction onto a transverse conveyor. However, fewer or more double tobacco sticks or also other articles 11 can be transferred using the apparatus 10. The division of the articles 11 as well as the length of the articles 11 in particular may also vary.

Figure 7:
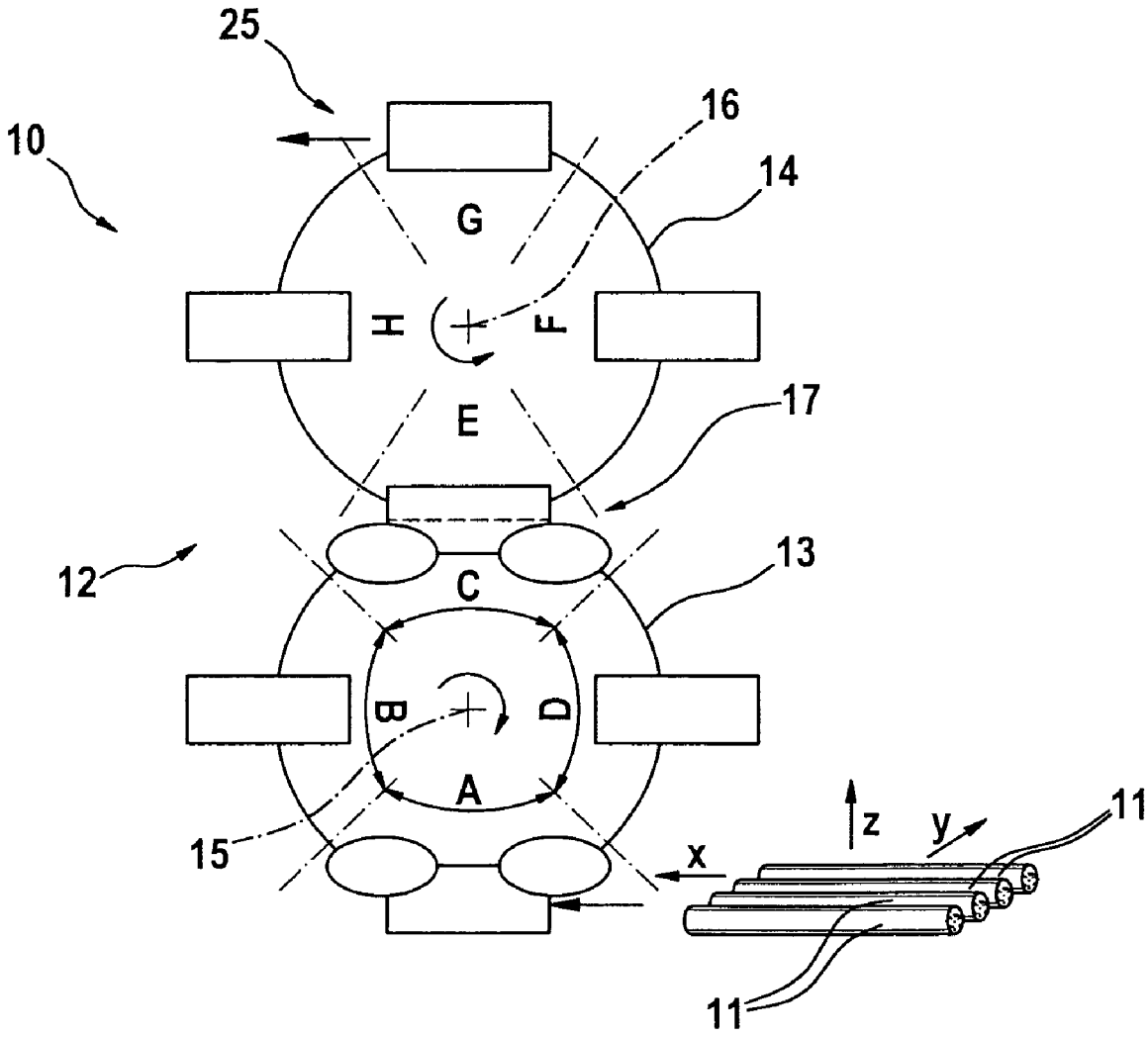
FIG. 7 shows a further schematic representation of the apparatus according to FIG. 1.

The basic principle of the process having the main functions of "rotate articles by 90°" and "reduce transport speed of the articles" can be described using FIGS. 1 and 7. The double tobacco sticks arrive at the taking-over position 17 in several tracks, e.g., four tracks, on the longitudinal conveyor at strand speed and are taken over in groups from the conveying element 13. In other words, the conveying element 13 with the trough segment 22 takes over four double tobacco sticks per cycle in longitudinal direction (x direction in FIG. 7) of the double tobacco sticks. The conveying element 13 or more precisely each trough segment 22 is guided in a segment (see A in FIG. 7) before, during and after taking-over of the double tobacco sticks parallel to the x direction by pivoting about the pivoting axis 23. That is, that the receiving elements 21 run parallel to the longitudinal conveyor, until a collision with an advancing or a delayed trough segment 22 or double tobacco sticks conveyed in the trough segments 22 is safely excluded. The trough segments 22 are thus followed relative to the rotational movement of the conveying elements 13. The actual rotation of the double tobacco sticks by 90° about the axis 31 (z axis in FIG. 7) then takes place in segment B (see FIG. 7), and specifically at a point in time when the trough segment 22 has been removed so far from the receiving position 20 until collision-free rotation is possible. The double tobacco sticks are then conveyed further (for example at strand speed) into segment C in their position rotated by 90°. In segment C, transfer of the double tobacco sticks takes place from the conveying element 13 to the conveying element 14. In order to guarantee transfer and to prevent collisions, guiding of the trough segments 22 is necessary before, during and after transfer in the region of segment C by pivoting about the pivoting axis 23. The double tobacco sticks are transferred to the conveying element 14 at strand speed in the region of segment C/E. Transfer is described in further detail below. In segment D, rotation of the trough segments 22 by −90° takes place, so that the trough segments 22 are ready to receive a further group of double tobacco sticks.

After taking-over the double tobacco sticks in segment E, in which the double tobacco sticks are guided one after the other from trough segment 22 into trough segment 27, the speed is reduced in segment F. The speed reduction, that is the braking process, takes place transversely to the axial alignment of the articles (y direction in FIG. 7), so that the double tobacco sticks in segment G have a transport speed which is lower compared to the strand speed. The radius of the movement track is thus reduced in the form described, in that the trough segments 27 are drawn back from an outer track curve 19 to an inner track curve 30. At the delivery position 25 in segment G, the double tobacco sticks are transferred with the transport division which is necessary for the downstream processing steps and a speed matching the transport division. In segment H, the speed of the trough segments 27 is increased again by increasing the radius, so that the trough segments 27 are prepared for taking-over further double tobacco sticks in segment E. The size of the segments A to H is only shown by way of example. Other gradations or divisions than the segment gradation shown are however likewise possible.

The exact transfer of double tobacco sticks in segment C or E is illustrated in more detail using FIGS. 6*a*) to *d*). As already mentioned, the trough segments 22 are guided in segment C. This means that the trough segments 22 are followed with respect to the conveying element 13, which has the direction of rotation indicated by arrow 34, that is relative to the conveying element 13. By pivoting/rotating the trough segments 22 about the pivoting axis 23, and specifically counter-clockwise, the advancing receiving element 21 of the trough segment 22 is moved out from the track curve 18 (see step a)), while the article 11 is transferred from the trough segment 22 to the trough segment 27. This is also necessary for safe transfer, since the receiving elements 26 of the trough segment 27 or the surface 32 are set back slightly with respect to the outer track curve 19 of the conveying element 14 due to the curvature. This following of the trough segment 22, that is the superimposed pivoting movement of the trough segment 22 for rotation of the conveying element 13 takes place during the entire transfer of all double tobacco sticks in a trough segment 22. For the delayed receiving element 21 of the trough segment 22, superimposed movement of the trough segment 22 takes place clockwise, so that the delayed receiving element 21 is moved out from the track curve 18 (see step d)).

Figure 3:
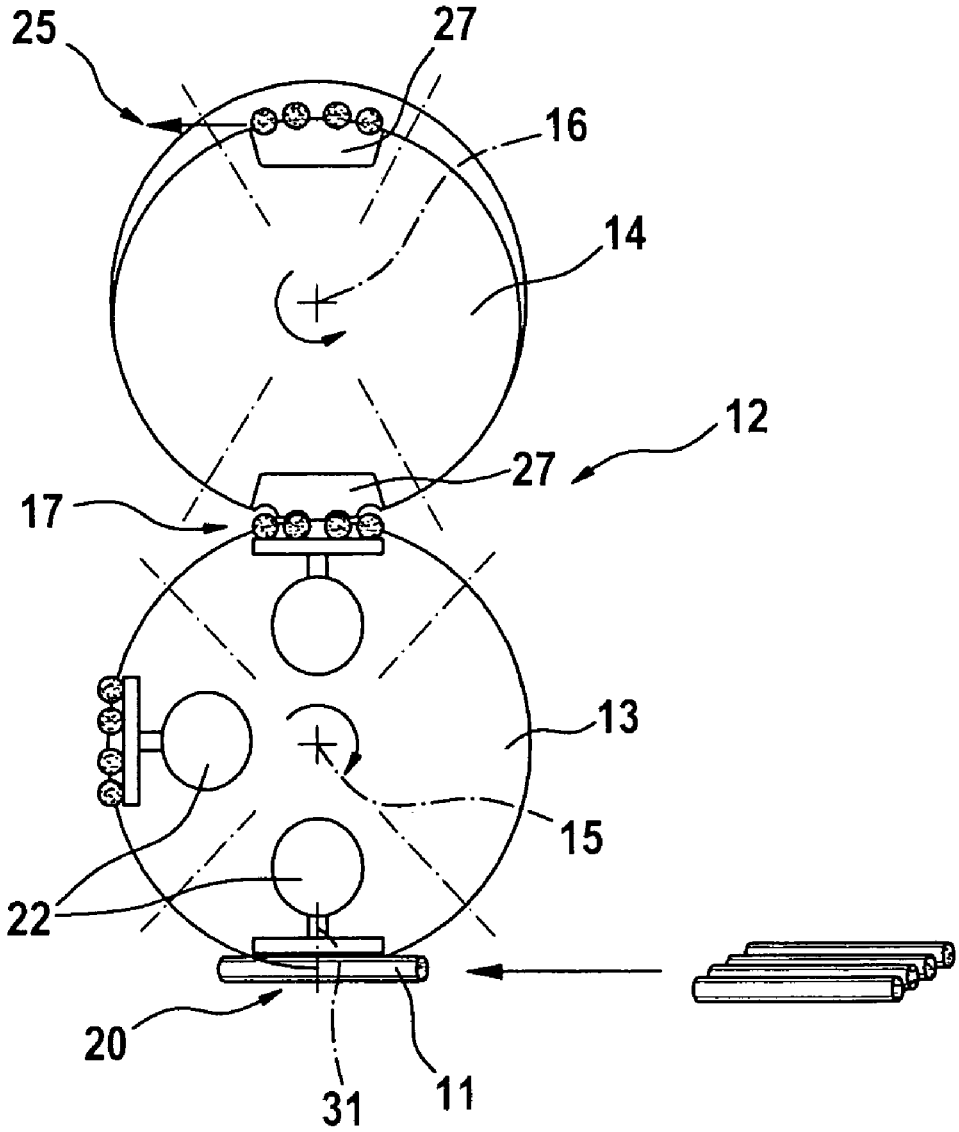
FIG. 3 shows a schematic representation of the front view of the apparatus according to FIG. 1, in which the rotational axes of the receiving drum and the delivery drum run parallel to one another.
Figure 4:
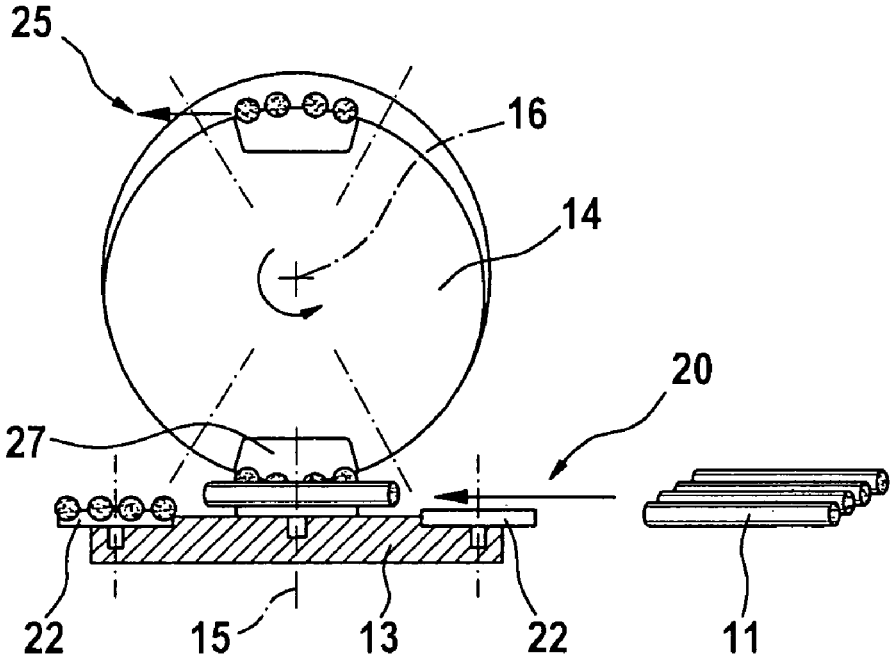
FIG. 4 shows a schematic representation of the front view of a further embodiment of the apparatus according to FIG. 1, in which the rotational axes of the receiving drum and the delivery drum run transversely to one another.
Figure 5:
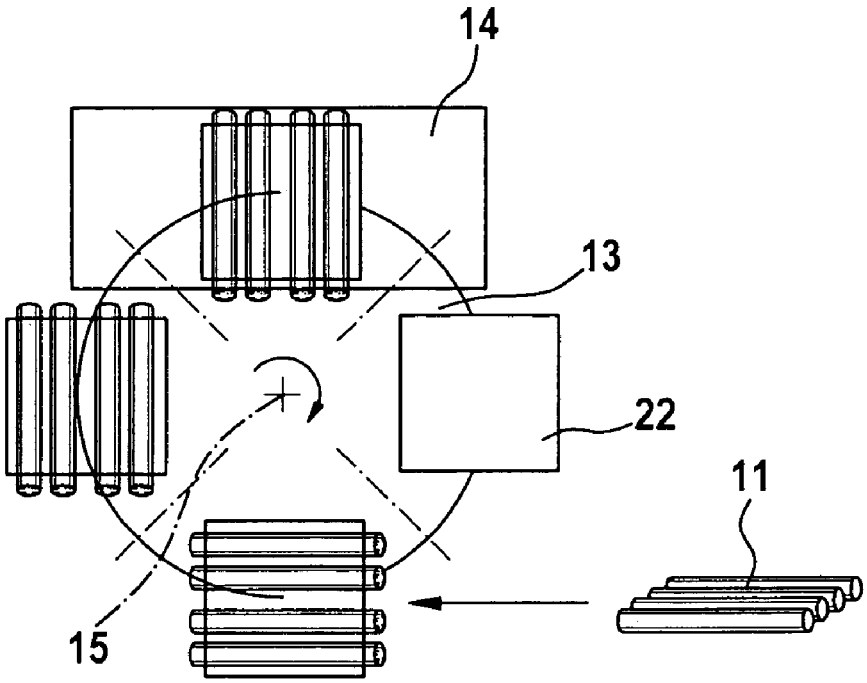
FIG. 5 shows a schematic representation of the plan view of the embodiment according to FIG. 4.
Figure 6:
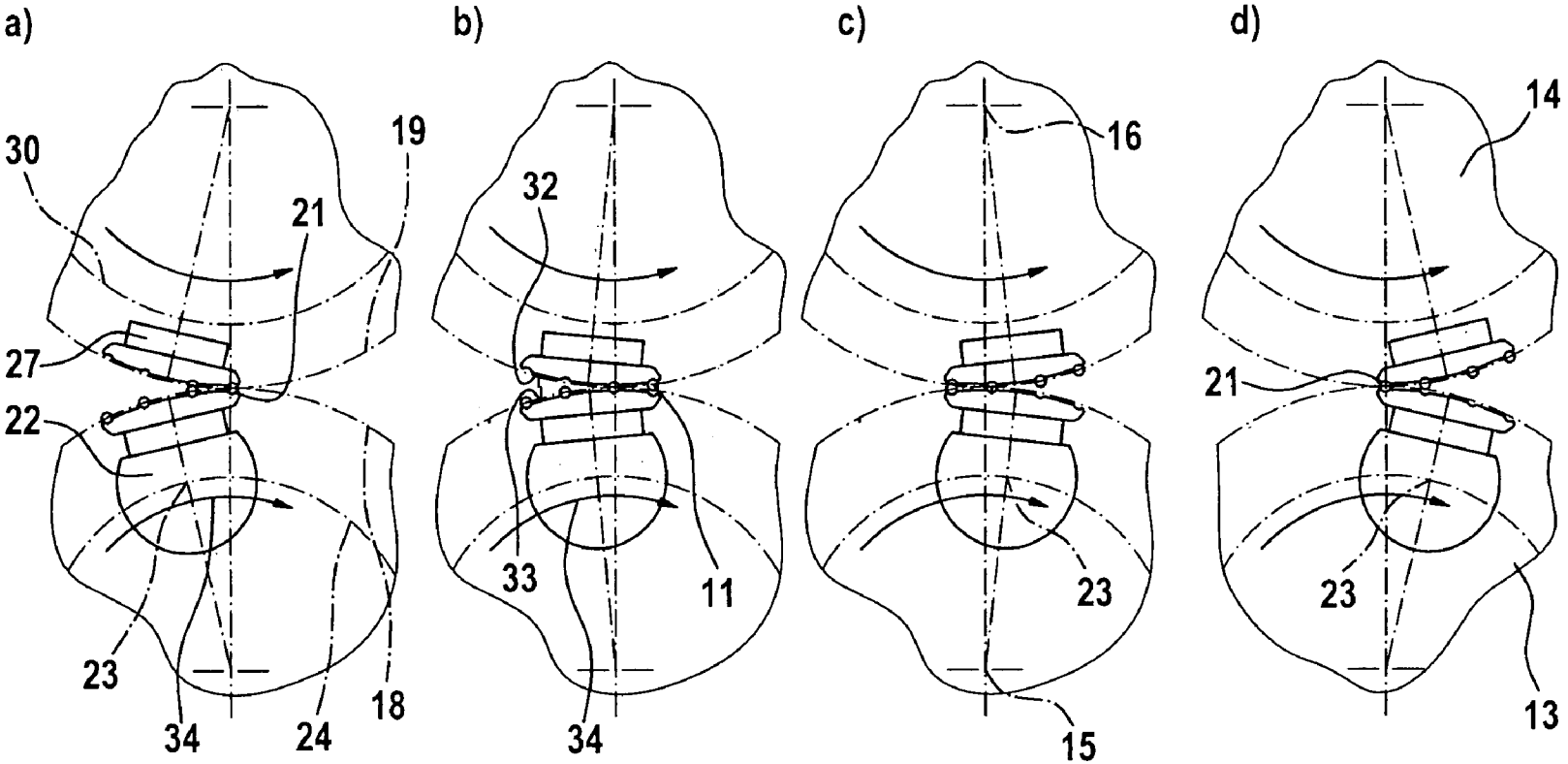
FIGS. 6*a*, 6*b*, 6*c*, and 6*d* show a detailed representation of the apparatus according to FIG. 1, namely the transfer region between the receiving drum and the delivery drum in different positions a) to d)

Further embodiments with the corresponding process steps are illustrated using FIGS. 3 to 5.

In the embodiment of FIG. 3, the conveying elements 13 and 14 are arranged one above another with parallel running rotational axes 15, 16. The conveying elements 13, 14 are driven in an opposite direction. The four parallel double tobacco sticks are taken over from the conveying element 13 from the top at the receiving position 20 in axial direction at strand speed. The double tobacco sticks are, as described above, rotated by 90° about the axis 31 and at strand speed to the taking-over position 17 and are transferred there to the conveying element 14. Transfer of the double tobacco sticks takes place segment by segment, wherein the four double tobacco sticks in a trough segment 22 are delivered one after another to the trough segment 27. Transfer takes place at strand speed, that is, at a speed which usually does not match the division of the trough segments 27. Matching of the speed takes place due to the conveying element 14. This takes place in that the trough segments 27 are moved at constant speed of the conveying element 14 along the transport path of about 180° (from the taking-over position 17 to the delivery position 25) from the track curve 19 to another track curve 30. In this case, the radius of the other track curve 30 is lower than the radius of the track curve 19. The (peripheral) speed of the double tobacco sticks is thus reduced, so that the division and the speed of the double tobacco sticks are matched in the region of the delivery position 25. A constant number of double tobacco sticks having constant division interval are therefore transferred per unit of time.

In the embodiment according to FIGS. 4 and 5, taking-over of the double tobacco sticks in the region of the receiving position 20 takes place horizontally. The rotational axes 15 and 16 of the conveying elements 13, 14 run transversely, that is at a right angle to one another. The conveying element 13 is designed as a conveying plate, whereas the conveying element 14 is designed as a drum. Receiving of the double tobacco sticks in axial direction at strand speed onto the conveying plate takes place in the region of the receiving position 20. To ensure transfer and to avoid collisions, guiding of the trough segments 22 is necessary. This may be achieved, for example in that the trough segments 22 are moved, that is raised, out of the rotational plane of the conveying element 13 at the point in time of receiving at the receiving position 20. After taking-over of the double tobacco sticks and lowering of the trough elements 22 back into the rotational plane, rotation of the double tobacco sticks by 90° may then take place. Moreover, transfer of the double tobacco sticks takes place as in the previously described method.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed:

1. An apparatus for transferring rod-like articles from a longitudinal conveyor that longitudinal-axially conveys the articles onto a transverse conveyor that transverse-axially conveys the articles, comprising:

a conveyor that receives the articles from the longitudinal conveyor and delivers the articles to the transverse conveyor, the conveyor comprising at least a first conveying element and a separate second conveying element which are configured to be in functional connection with one another;

the first conveying element being structured and arranged to rotate the articles by a predetermined angle; and the second conveying element being structured and arranged to reduce the transport speed of the articles, wherein:

the first and second conveying elements are each structured and arranged as a rotational conveying body that comprises one of a drum and disc configured to be driven to rotate about a rotational axis;

the first conveying element comprises a plurality of trough segments, each of the plurality of trough segments comprising a plurality of receiving elements configured to at least one of remove and deliver the rod-like articles, each of the plurality of trough segments being arranged to be rotatable, by said predetermined angle, about a rotational axis other than the rotational axis about which the first conveying element rotates;

the second conveying element comprises at least one trough segment comprising a plurality of receiving elements configured to at least one of remove and deliver the rod-like articles.

2. The apparatus according to claim 1, wherein the first and second conveying elements are arranged sequentially in a transport direction of the articles.

3. The apparatus according to claim 1, wherein the second conveying element is positioned downstream of the first conveying element.

4. The apparatus according to claim 1, wherein the trough segments of the first and second conveying elements comprise four receiving elements.

5. The apparatus according to claim 4, wherein the plurality of trough segments of the first conveying element comprises eight trough segments configured to rotate about the rotational axis of the first conveying element and each of the eight trough segments is structured and arranged to be rotatable about a rotational axis other than the rotational axis of the first conveying element.

6. The apparatus according to claim 4, wherein the at least one trough segment of the second conveying element comprises six trough segments which are structured and arranged to be movable to change a radial position.

7. The apparatus according to claim 6, wherein the trough segments of the second conveying element are arranged on pivoting levers such that the trough segments of the second conveying element can be configured to be moved on a plurality of track curves each having different radius.

8. The apparatus according to claim 1, wherein a transport path of the articles within the conveyor is at least 360°.

9. The apparatus according to claim 1, wherein a transport path to rotate the articles and the transport path to reduce the conveying speed of the articles are each at least 180°.

10. The apparatus according to claim 1, wherein rotational axes of the first and second conveying elements are parallel to one another.

11. The apparatus according to claim 1, wherein rotational axes of the first and second conveying elements are transverse to one another.

12. The apparatus according to claim 1, wherein the rod-like articles comprise cigarettes.

13. An apparatus for transferring rod-like articles from a longitudinal conveyor, which conveys said rod-like articles in a longitudinal-axially conveyed direction, to a transverse conveyor, which conveys said rod-like articles in a transverse-axially conveyed direction, comprising:

a first drum or disc conveyor having a plurality of discrete article-receiving segments to rotate about an axis of said first conveyor, each of said segments structured and arranged to receive a plurality of rod-like articles from said longitudinal conveyor in an axial orientation and to convey said plurality of rod-like articles about the axis of said first conveyor at a transport speed, said first conveyor further structured and arranged to additionally rotate said plurality of rod-like articles about an axis of a respective article-receiving segment by a predetermined angle to position said plurality of rod-like articles in a transverse orientation; and a second drum or disc conveyor having a plurality of discrete article-receiving segments to rotate about an axis of said second conveyor, each of said segments structured and arranged to receive said plurality of rod-like articles from said first conveyor at a transfer station in said transverse orientation and to convey said plurality of rod-like articles about the axis of said second conveyor while in said transverse orientation, said second conveyor further structured and arranged to reduce the transport speed of said plurality of rod-like articles while said articles are in said transverse orientation for transfer to the transverse conveyor at the reduced transport speed;

said first and second conveyors being arranged sequentially in a transport direction of the articles.

14. The apparatus according to claim 13, wherein each of the first and second conveyors comprises a plurality of receiving elements that are configured to at least one of remove and deliver the articles.

15. The apparatus according to claim 14, further comprising:

at least one trough segment, each trough segment comprising four receiving elements of the plurality of receiving elements.

16. The apparatus according to claim 13, wherein the rod-like articles comprise cigarettes.

17. The apparatus according to claim 13, wherein the axes of the first and second conveyors are mutually parallel and lie in a single vertical plane.

* * * * *